United States Patent [19]

Sato et al.

[11] 4,163,223

[45] Jul. 31, 1979

[54] BUZZER WITH ELECTRONIC INTEGRATED OSCILLATION CIRCUIT

[75] Inventors: Yukio Sato, Mototaka Harakawa, Yoshio Mitumori, all of Shizuoka, Japan

[73] Assignee: Star Seimitsu Kabushiki Kaisha, Shizuoka, Japan

[21] Appl. No.: 871,403

[22] Filed: Jan. 23, 1978

[30] Foreign Application Priority Data

Jan. 21, 1977 [JP] Japan ..... 52-6501[U]

[51] Int. Cl.[2] ..... G08B 3/00

[52] U.S. Cl. ..... 340/384 R; 340/388; 340/384 E

[58] Field of Search ..... 340/384 R, 384 E, 388

[56] References Cited

U.S. PATENT DOCUMENTS 3,950,744 4/1976 Stephens ..... 340/384 R

*Primary Examiner*—Harold I. Pitts

*Attorney, Agent, or Firm*—Holman & Stern

[57] ABSTRACT

A buzzer comprises a vibration unit, an electromagnet transducer for applying an electromagnetic excitation to the unit, and an electronic oscillation circuit for driving the transducer. The oscillation circuit includes a group of electrical components which constitute a blocking oscillator together with the coil assembly of the transducer and which are contained on a bipolar integrated circuit module. The module is mounted on the coil bobbin of the transducer.

5 Claims, 7 Drawing Figures

BUZZER WITH ELECTRONIC INTEGRATED OSCILLATION CIRCUIT

FIELD AND BACKGROUND OF THE INVENTION

The invention relates to an electromagnetic buzzer having a vibration unit which is excited by an electromagnet transducer which induces a regularly varying magnetic field, and more particularly a buzzer with integrated electronic oscillation circuit which drives the electromagnet transducer.

A buzzer having a vibration unit which produces an audible signal in response to the excitation from an electromagnet transducer is known in several forms, which differ in the manner of exciting the vibration unit. In one practical form, a diaphragm formed of a magnetic material is magnetically excited in a direct manner. A modification thereof comprises a diaphragm of a non-magnetic material having an armature, formed by either permanent magnet or iron piece, mounted thereon, which armature is effective to cause an oscillation of the diaphragm. In another form, a diaphragm is physically impacted by a striker on a vibrating member which is in turn excited. In these forms of buzzers, an audible signal is produced as a result of the oscillation of the diaphragm. On the other hand, a further form of the buzzer is known. A striker on a vibrating member impacts the core of an electromagnet transducer, thereby producing a percussion sound. The present invention is applicable to either form of buzzer.

To induce a regularly varying magnetic field in the electromagnet transducer, the latter includes an electronic oscillation circuit such as a blocking oscillator. Such oscillation circuit is disclosed, for example, in U.S. Pat. No. 3,887,914 issued to Sato et al and No. 3,945,004 issued to Myers but the specific detail of such circuit does not form any part of the present invention.

DESCRIPTION OF THE PRIOR ART

In conventional buzzers, electrical components which form the electronic oscillation circuit are mounted on a printed circuit board which is contained in a housing together with the electromagnet transducer. Various arrangements of such printed circuit board within the housing will be seen in U.S. Pat. No. 3,564,542 issued to Arai, No. 3,846,792 issued to Haigh, No. 3,887,914 issued to Sato et al, No. 3,931,549 issued to Berns et al and No. 3,950,744 issued to Stephens et al. However, a buzzer having a printed circuit board of known form suffers from the disadvantage that the printed circuit board and electrical components carried thereon assume a large proportion of space within the housing, which prevents a compact buzzer, as may be assembled into a watch or clock, from being manufactured. In addition, the construction of the printed circuit board assembly is a time and labor expending operation as is its mounting in the housing. Thus it will be seen that there has been a need for an inexpensive buzzer which can be manufactured on a mass production basis.

SUMMARY OF THE INVENTION

It is an object of the invention to provide a compact buzzer which is easily assembled.

It is a specific object of the invention to provide a buzzer having an electronic oscillation circuit which is formed by an integrated circuit module.

In accordance with the invention, there is provided a buzzer comprising a vibration unit; an electromagnet transducer for electromagnetically exciting the vibration unit and including a core which is operatively disposed with respect to the vibration unit, a bobbin fitted on the core and a coil assembly disposed on the bobbin; and electrical components which cooperate with the coil assembly to form an electronic oscillation circuit, the electric components being formed on or in an integrated circuit module which includes terminals for connection of the oscillation circuit with the power source and other terminals for connection of the coil assembly with the oscillation circuit, the module being mounted on the bobbin.

In the buzzer of the invention, the electronic oscillation circuit may comprise a blocking oscillator of a known form. Such circuit has electric components including at least one transistor and a bias resistor therefor which cooperate with a drive and a control coil of the coil assembly. In this arrangement, the drive coil is connected in series with the collector-emitter path while the control coil is connected in series with the base-emitter path of the transistor. The circuit may additionally include a plurality of diodes which provide a compensation for a change in the characteristic thereof due to variations in the source voltage and/or ambient temperature. The connection of such diodes in series or parallel with the control circuit is already known as is their connection in parallel with the drive coil. Achieving electrical functions of transistor, resistor, capacitor, diode and the like with an integrated circuit module is well known, and therefore it is the only requirement of the invention that the electronic oscillation circuit be formed of such electrical components.

The integrated circuit module used in the present invention represents a flat packaged bipolar monolithic integrated circuit, which may be manufactured in a size of $4\times4\times2.3$ mm, for example. The integrated circuit may be provided with six terminals or pins for connection with the power source, drive coil and control coil, respectively. In accordance with the invention, the integrated circuit module may be embedded in one of flanges formed at the ends of a bobbin used in the electromagnet transducer, or may be mounted across the both flanges.

DESCRIPTION OF PREFERRED EMBODIMENTS

Figure 1:
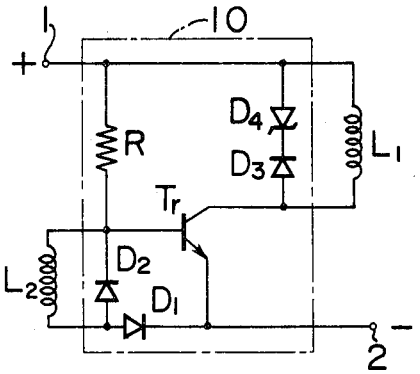
FIG. 1 is a circuit diagram of an electronic oscillation circuit which may be used in the buzzer of the invention.

Referring to FIG. 1, there is shown an exemplary electronic oscillation circuit which is preferred for use in the buzzer of the invention. The circuit arrangement is generally similar to that of a known blocking oscillator and therefore will not be described in detail. However, briefly, the circuit includes a pair of source terminals 1, 2 between which is connected a series combination of a drive coil $L_1$ and the collector-emitter path of a transistor Tr. The series combination is shunted by another series circuit including a bias resistor R for the transistor and a control coil $L_2$. The junction between the resistor R and control coil $L_2$ is connected with the base of the transistor. Both the drive and the control coil $L_1$, $L_2$ is a bifilar winding disposed on a common magnetic core to achieve a close inductive coupling therebetween. A diode $D_1$ which compensates for a variation in the ambient temperature is connected in series between the control coil $L_2$ and the source terminal 2 and forwardly poled. The control coil is shunted by a diode $D_2$ which is forwardly poled to compensate for a variation in the source voltage. The drive coil $L_1$ is shunted by a series combination of a diode $D_3$ and a Zener diode $D_4$ which prevents the effect of a back electromotive force.

Figure 2:
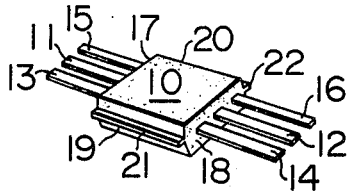
FIG. 2 is a perspective view of an integrated circuit module containing the electrical components which are shown within a phantom line block of FIG. 1.

In accordance with the invention, the electric components of the oscillation circuit other than the drive coil $L_1$ and the control coil $L_2$, namely those components shown in a block indicated by a phantom line, are contained in a bipolar monolithic integrated circuit module 10. Referring to FIG. 2, the module 10 is shown as a rectangular package molded from an electrically insulating synthetic resin. The module is provided with six conductive metal terminals, including forks 11, 12 for connection with the power source, forks 13, 14 for connection with the drive coil $L_1$ and forks 15, 16 for connection with the control coil $L_2$. It will be noted that the forks 11, 13 and 15 which are at relatively positive potentials are located on one side 17 of the module 10 and are disposed in parallel spaced relationship with each other while the forks 12, 14 and 16 which are at relatively negative potentials are located on the opposite side 18 thereof and are similarly disposed. The positive fork 13 associated with the drive coil $L_1$ may be dispensed with by sharing the positive fork 11 for the power source, but their separate provision is desirable in consideration of the soldering operation during the assembly of the buzzer. The module 10 are provided with a pair of ribs 21, 22 on its sides 19, 20 which are transverse to the group of forks 11 to 16 and which are at the same elevation as the latter.

Figure 3:
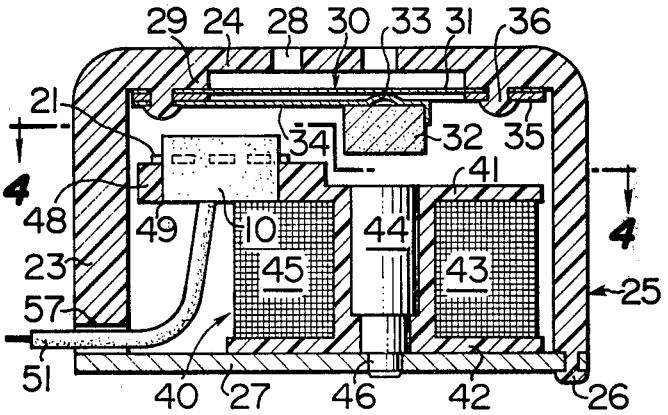
FIG. 3 is a vertical cross section of the buzzer of the invention.

FIG. 3 shows a buzzer incorporating the integrated circuit module 10 shown in FIG. 2. The buzzer comprises a cup-shaped housing 25 including a sidewall 23 and a top wall 24, and a baseplate 27 attached to the end of the sidewall 23 by means of the rivet 26 so as to close the bottom opening of the housing 25. The top wall 24 is formed with a plurality of apertures 28, and is internally formed with a shoulder 29 on which a vibration unit generally shown at 30 is carried. The vibration unit 30 comprises a diaphragm 31 which may be formed as a thin sheet or film of a metal or synthetic resin, a cantilever vibrating arm 34 carrying a permanent magnet armature 32 and a striker 33 on its free end, and a spacer ring 35 interposed between the vibrating arm 34 and the diaphragm 31. The use of a plurality of rivets 36 formed on the shoulder 29 to support the vibration unit 30 is described in detail in U.S. Pat. No. 3,974,499, assigned to the common assignee as the present application, to which reference is made.

An electromagnet transducer generally indicated by numeral 40 is mounted on the baseplate 27 within the housing 25. The construction of such transducer is well known. Specifically, it comprises a coil bobbin 43 having a pair of flanges 41, 42 at its opposite ends, a core 44 of a magnetic material disposed inside the bobbin 43, and a coil assembly 45 disposed around the bobbin 43. The core 44 has a vertical axis which is perpendicular to the diaphragm 31, and has its one end disposed at a spacing from the armature 32 of the vibrator arm 34 while its other end 46 is fixedly mounted on the baseplate 27. The coil assembly 45 comprises the pair of coils $L_1$, $L_2$ shown in FIG. 1 which comprise a bifilar winding, as mentioned previously, and which are disposed for mutual inductive coupling between them.

Figure 4:
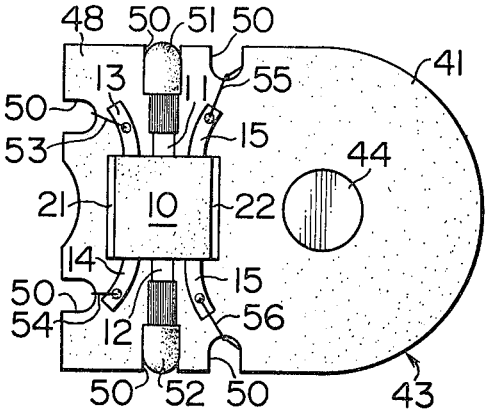
FIG. 4 is a plan view as seen from the line 4—4 of FIG. 3.

Referring to FIG. 4 together with FIG. 3, it will be noted that the upper flange 41 of the bobbin 43 has a lateral extension 48 having an opening 49 formed therein in which the integrated circuit module 10 is supported. The module 10 is a close fit in the opening 49 and the ribs 21, 22 provided along the opposite sides thereof engage the opposite edges of the opening 49. The six forks 11 to 16 extending from the module 10 extend along the upper surface of the extension 48. The module 10 may be adhesively secured to the upper flange 41 around its periphery. The extension 48 is formed with six notches 50, through which source connecting lead wires 51, 52, drive coil lead wires 53, 54 and control coil lead wires 55, 56 are passed to lead to the corresponding forks 11 to 16 for connection therewith by soldering. The forks 13, 14 for connection with the drive coil $L_1$ and the forks 15, 16 for connection with the control coil $L_2$ are slightly curved in a direction away from the adjacent forks 11, 12 for the purpose of facilitating the soldering operation. The lead wires 51, 52 for connection with the power source extends through an opening 57 formed in the sidewall 23 to the exterior of the housing 25.

In operation, when a voltage is applied across the lead wires 51, 52, the module 10 cooperates with the drive coil $L_1$ and control coil $L_2$ to induce a regularly varying magnetic field through the core 44, which field excites the vibrating arm 34 to cause the striker 33 thereon to impact the diaphragm 31, thus producing an audible signal.

Figure 5:
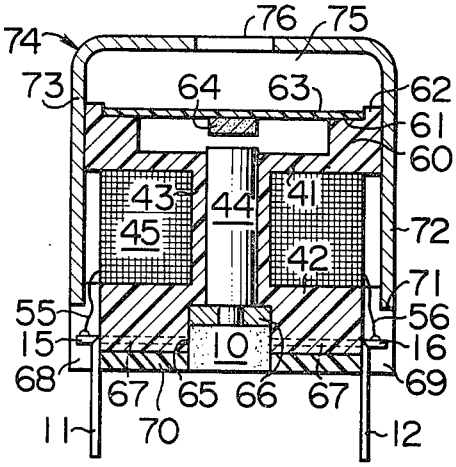
FIG. 5 is a cross section of another embodiment of the invention.

Referring to FIG. 5, the application of the invention to a buzzer of a slightly different form is illustrated. In this embodiment, similar parts are designated by like numerals as in FIG. 3. The upper flange 41 of the coil bobbin 43 is provided with an axially extending annular extension 60 around the periphery on the side thereof which is remote from the coil assembly 45, with the annular extension 60 terminating in an upper end 61 which lies in a flat plane. A small rib 62 extends around the end 61. In this embodiment, the vibration unit 30 comprises a flat diaphragm 63, and an armature 64 centrally supported on the diaphragm 63. The peripheral edge of the diaphragm 63 is adhesively secured to the end 61 of the annular portion 60, thereby supporting the vibration unit 30. The armature 64 is disposed in opposing relationship from the upper end of the core 44, and is spaced therefrom at rest. The diaphragm 63 may comprise a thin metal film of a cold rolled steel or a thin film of a synthetic resin such as polycarbonate resin.

The armature 64 may be formed of a rare earth magnet such as samarium cobalt magnet or iron, for example.

The lower flange 42 of the bobbin 43 has an increased thickness and is centrally formed with an opening 65 in which the integrated circuit module is supported. A magnetic plate 66 is disposed at the bottom of the opening 65 and is rigidly connected with the lower end 46 of the core 44. The lower surface of the lower flange 42 is formed with a plurality of slots 67 for receiving the forks 11 to 16 of the module 10, these slots 67 providing a communication between the opening 65 and notches 68, 69 formed on the opposite sides of the lower flange 42. When the module 10 is received in the opening 65, the forks 11 to 16 extend through the slots 67 to reach the notches 68, 69. The forks 13, 14 for connection with the drive coil $L_1$ and the forks 15, 16 for connection with the control coil $L_2$ have a length which permits their free end to project slightly into the notches 68, 69, so that they can be soldered with lead wires 53 to 56 within the notches. The forks 11, 12 for connection with the power source is bent at right angles to extend in the downward direction within the notches 68, 69 and has a substantial length. The bottom of the lower flange 42 is formed with a shallow recess into which a bottom cover 70 of a synthetic resin is fitted. The cover 70 is centrally formed with an aperture for engagement with the module 10 so that the bottom surface of the module 10 is flush with the lower surface of the cover 70.

The lower flange 42 has a diameter which is slightly greater than that of the upper flange 41 and is peripherally formed with an annular notch 71 on the side adjacent to the coil 45. A cup-shaped cover 74 including a sidewall 72 and a top wall 73 is placed on top of the bobbin 43, and the lower end of the sidewall 72 engages the annular notch 71. The cover 74 is detachably mounted by frictional engagement with the peripheral edge of the upper flange 41. The cover 74 provides a protection for the vibration unit 30 and the coil assembly 45, and also forms a cavity 75 between the top wall 73 and the diaphragm 63, which cavity functions as a resonance chamber. It will be noted that the top wall 73 is formed with an opening 76.

Since the buzzer of this embodiment has the source connecting forks 11, 12 which extend externally, these forks can be advantageously utilized to mount it on an external printed circuit board or a receptacle having corresponding mating slots. The absence of a housing enables the buzzer to be assembled in a reduced size. In operation, when an oscillating magnetic field is induced through the core 44, the armature 64 oscillates together with the diaphragm 63, whereby the latter produces an audible signal.

Figure 7:
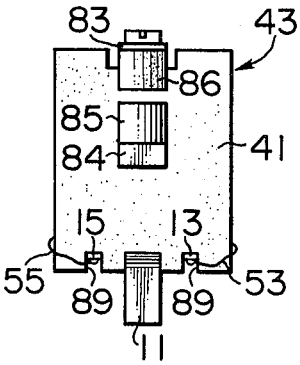
FIG. 7 is a side elevation as taken along the line 7—7 of FIG. 6.
Figure 6:
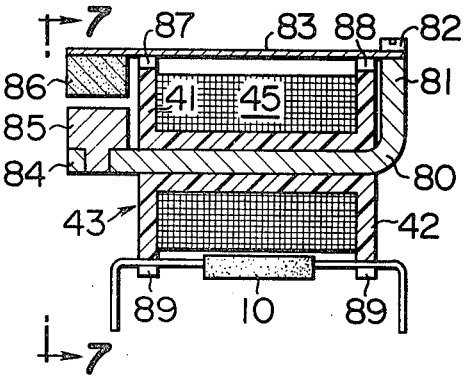
FIG. 6 is a cross section of a further embodiment of the invention.

FIGS. 6 and 7 shows a further embodiment of the buzzer having an L-shaped core 80 which extends through the bobbin 43. A cantilever vibrating arm 83 is mounted on one end 81 of the core by means of rivet 82, and cooperates with a yoke 85 secured to the other end 84 of the core, producing a percussion sound. Specifically, an armature 86 formed by a permanent magnet or iron piece is mounted on the free end of the vibrating arm 83, and is disposed in opposing relationship with the yoke 85 but is spaced therefrom at rest. When an oscillating magnetic field is induced through the core 80, the armature impacts the yoke 85. The bobbin 43 is formed with a pair of square flanges 41, 42 at its opposite ends, which are formed with notches 87, 88 through which the vibrating arm 83 extends. An integrated circuit module 10 is disposed across the flanges 41, 42 by engaging the forks 11 to 16 projecting from the module 10 with notch 89 formed in the respective flanges 41, 42 and adhesively securing them thereto. The forks 13, 14 for connection with the drive coil $L_1$ and the forks 15, 16 for connection with the control coil $L_2$ have their free end projecting slightly outside the flanges 41, 42 for soldering with associated lead wires 53 to 56 extending from the coil assembly 45. The forks 11, 12 for connection with the power source is bent at right angles to extend in the downward direction outside the respective flanges 41, 42 and have a substantial length. Consequently, this buzzer can also be mounted on an external printed circuit board or a receptacle having corresponding mating slots, by utilizing the forks 11, 12 in the similar manner as the buzzer shown in FIG. 5.

While several preferred embodiments of the invention have been described in detail, it should be understood that they are illustrative only and not limitative of the invention, and that a number of modifications and changes can be made therein without departing from the spirit and the scope of the invention.

What is claimed is:

1. A buzzer comprising a vibration unit; an electromagnet transducer for electromagnetically exciting the vibration unit and including a core which is operatively disposed with respect to the vibration unit, a bobbin fitted on the core and a coil assembly disposed on the bobbin; and electrical components which cooperate with the coil assembly to form an electronic oscillation circuit, the electric components being formed on or in an integrated circuit module which includes terminals for connection of the oscillation circuit with the power source and other terminals for connection of the coil assembly with the oscillation circuit, the module being mounted on the bobbin.

2. A buzzer according to claim 1 in which the coil assembly comprises a pair of coils, the electronic oscillation circuit comprising a blocking oscillator including a transistor and a bias resistor therefor and also including the pair of coils, the transistor and the bias resistor being incorporated into the integrated circuit board.

3. A buzzer according to claim 1 in which the bobbin is provided with a flange at least one of its axial ends, the integrated circuit module being mounted on the flange.

4. A buzzer according to claim 1 in which the bobbin is provided with a pair of flanges at its both axial ends, the vibration unit being carried by one of the flanges and the integrated circuit module being carried by the other flange.

5. A buzzer according to claim 1 in which the integrated circuit module has a plurality of terminals which are formed by forks of a rigid conductive metal which project from mutually opposite sides of the module, the bobbin being provided with a pair of flanges at its both axial ends, the integrated circuit module extending across the flanges and having its forks secured to the both flanges.

* * * * *